United States Patent [19]

Girden

[11] 3,950,030

[45] Apr. 13, 1976

[54] UNDERWATER MINING

[76] Inventor: Barney Girden, P.O. Box 725, Norwich, Conn. 06360

[22] Filed: Aug. 2, 1974

[21] Appl. No.: 494,065

Related U.S. Application Data

[63] Continuation-in-part of Ser. No. 285,870, Sept. 1, 1972, which is a continuation-in-part of Ser. No. 154,986, June 21, 1971, abandoned, which is a continuation-in-part of Ser. No. 41,432, May 28, 1970, Pat. No. 3,683,627.

[52] U.S. Cl. ..... 299/9; 37/59; 209/458; 209/506; 302/15

[51] Int. Cl.[2] ..... E02F 7/06

[58] Field of Search ..... 299/8, 9; 37/58, 59, 61; 56/8; 43/6.5; 302/15; 209/458, 460, 506

[56] References Cited

UNITED STATES PATENTS

| | | | |
|---|---|---|---|
| 594,041 | 11/1897 | Strong | 299/9 |
| 621,377 | 3/1899 | Sheppard | 299/9 |
| 2,205,490 | 6/1940 | Peterson | 37/61 X |
| 3,514,881 | 6/1970 | Hadjidakis | 37/58 |
| 3,657,829 | 4/1972 | Lovelace | 302/15 |

*Primary Examiner*—Ernest R. Purser
*Attorney, Agent, or Firm*—Albert W. Hilburger

[57] ABSTRACT

Methods and apparatus for underwater mining by inducing upwelling of water and entrained minerals or other materials through a conduit from an intake which may move within the body of water by unbalanced forces developed therein by such upwelling to a recovery field which may comprise a vessel floating on the water and which may also be moved by the upwelling water. The outlet of the conduit to the recovery field is positioned below sea level and the velocity of the upwelled water in the recovery field is gradually reduced to induce selective separation of the entrained minerals or other materials.

12 Claims, 7 Drawing Figures

UNDERWATER MINING

This application is a continuation-in-part of my co-pending application Ser. No. 285,870 filed Sept. 1, 1972 which in turn is a continuation-in-part of my co-pending application Ser. No. 154,986, filed June 21, 1971, now abandoned, which in turn is a continuation-in-part of my earlier application Ser. No. 41,432, filed May 28, 1970, now U.S. Pat. No. 3,683,627 and the entire disclosures thereof are expressly incorporated herein by reference as fully and completely as if reproduced hereat.

The present invention relates generally to mining and, more particularly, to mining under water.

Recently, research has demonstrated the presence of enormous stores of riches in water and in the land underneath, particularly in lakes, on the Continental shelf, ocean areas and floors of estuaries. Various nutrients and minerals, including oil, tin, gold and diamonds are known to be available in the depths of the ocean and various efforts are being made for their recovery.

This planet is predominantly a water world but at present, our knowledge of the resources in the ocean and on the ocean's bed is limited. As our civilization develops, however, our need for resources increases but our ability to recover the resources from the ocean and on the ocean bed is limited.

Prospecting for undersea minerals is so new that scientists have not yet been able to estimate the value of the mineral wealth that lies on and under the ocean floors. They do know, however, that it is a vastly greater treasure trove than has been found on and under dry land.

Diamonds are now mined at sea, for a vast treasure trove of these precious gems lies under the ocean floor. On land, in the great diamond mines which were considered rich, it was necessary to move 95,000,000 pounds of material to recover a single average diamond of 1.19 carats.

However, by dredging off the Continental shelf, for example, it has been possible to bring up and recover approximately 4 carats for every 2,000 pounds of material. Gold also has been successfully mined from under water and, for example, it has been speculated by some geologists that off the Alaskan coast there are some areas rich in gold. In one area of 5,120 acres, it has been estimated that some 300 tons of gold could be recovered. Deducting the highest cost likely for bringing up the gravel and processing it to extract the gold, a profit of over $150,000,000 could be derived from such an area. Many other minerals, less romantic but as industrially useful, are also known to exist in the silt on the ocean floor. For example, a single mineral, phosphorite, is a vital ingredient of fertilizers. The present world production of some 40,000,000 tons a year falls far short of the minimum needs of present day agriculture. It has been reported that finds of this precious mineral in easily accessible spots off the Continental shelf far exceed all of that of which exists in all the known reserves on land.

A few years ago, ocean prospectors dredging up samples of earth from the sea floor near Kyushu, the southernmost island in Japan, announced that they had struck one of the world's greatest deposits of iron. They calculated that lying in shallow water was at least 1,700,000,000 tons of magnetite sand. Samples showed it to be almost unbelievably rich in iron. Since then, mining engineers have found, off the Bahamas as much as 50 billion tons of aragonite sand which can be easily mined with simple dredging equipment.

It is a primary object of the present invention, therefore, to provide methods and apparatus of recovering materials from the ocean floors and mining these floors for their resources.

Another primary object of the present invention, in addition to the foregoing object, is the provision of methods and apparatus for efficiently dredging materials from the floors beneath bodies of water.

Yet another primary object of the present invention, in addition to each of the foregoing objects, is the provision of novel methods and apparatus for recovering materials from the depths of bodies of water.

Yet another primary object of the invention, in addition to each of the foregoing objects, is the provision of mobile collecting vessels for mining the depths.

A still further primary object of the present invention, in addition to each of the foregoing objects, is the provision of novel methods and apparatus for separating materials of differing densities from a flow of water.

A still further primary object of the present invention, in addition to each of the foregoing objects, is the provision of novel methods and apparatus for separating materials from an entraining stream of water.

Yet another still further primary object of the present invention, in addition to each of the foregoing objects, is the provision of novel methods and apparatus for mining diamonds, gold and other minerals.

Still another primary object of the present invention, in addition to each of the foregoing objects, is the provision of novel methods and apparatus for recovering material from substantially any level of a body of water, whether on the surface, below the surface or on the bottom thereof.

Still another primary additive to the present invention, in addition to each of the foregoing objects, is the provision of novel methods and apparatus for recovering and/or separating minerals and other materials from beneath or within a body of water.

Yet still another primary object of the present invention in addition to each of the foregoing objects, is the provision of novel methods and apparatus for controllably reducing the velocity of a stream of moving water having mineral or other materials entrained therein, so as to cause the selective drop-out or precipitation and separation of such entrained materials.

Yet another and still further primary object of the present invention, in addition to each of the foregoing objects, is the provision of novel methods and apparatus for moving the intake valve of a conduit through a body of water.

The invention resides in the combination, construction, arrangement and disposition of the various component parts and elements incorporated in improved mining apparatus constructed and in methods of mining in accordance with the principles of this invention. The present invention will be better understood and objects and important features other than those specifically enumerated above will become apparent when consideration is given to the following details and descriptions, which, when taken in conjunction with the drawings describe, disclose, illustrate and show a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved especially if they fall within the scope and the spirit of the subjoined claims.

IN THE DRAWING

Figure 1:
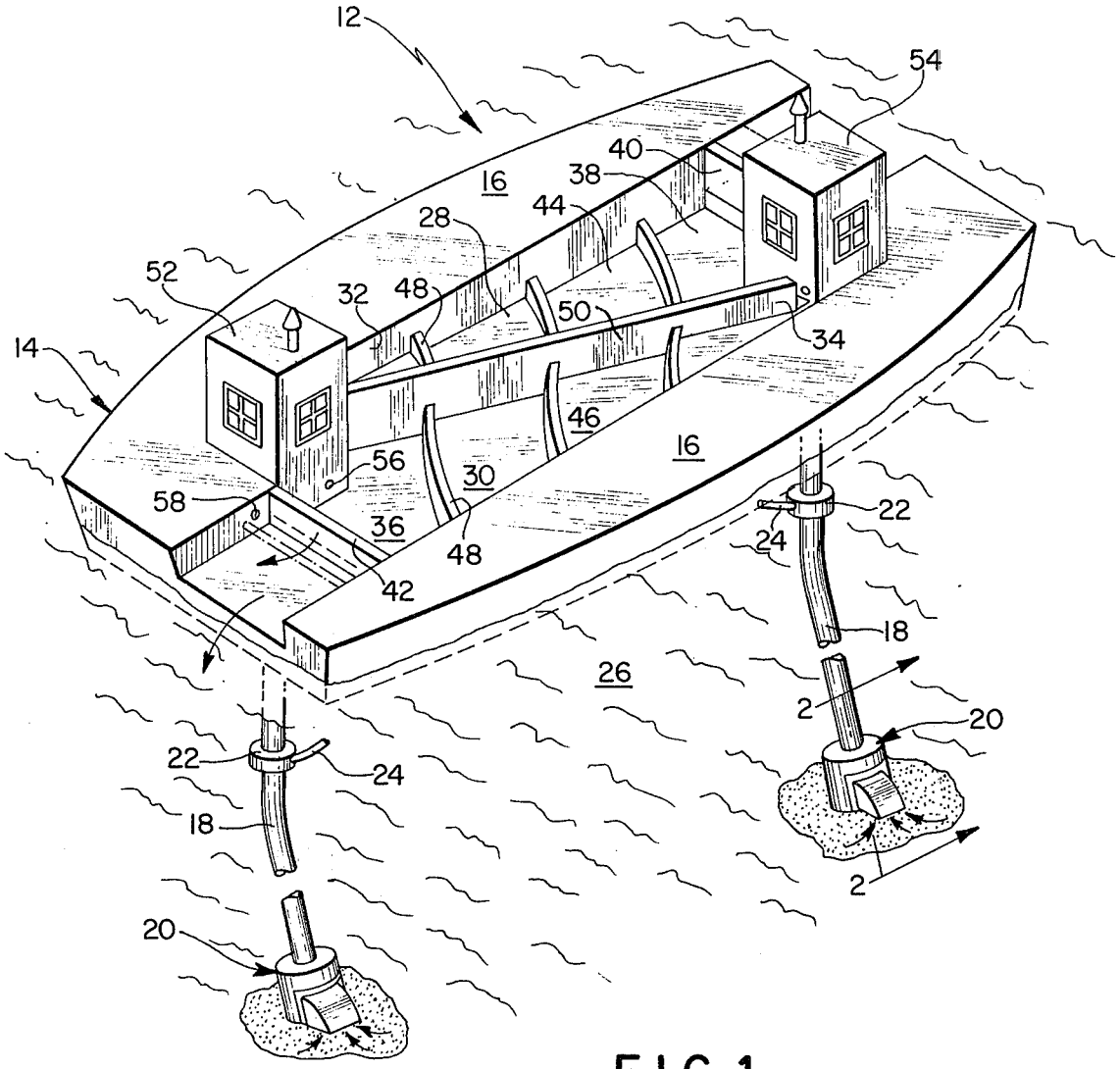
FIG. 1 is a diagrammatic illustration of a vessel and apparatus in accordance with the present invention for underwater mining utilizing the methods of the present invention.

Air lift pumps raising water above the surface can be efficient for a low lift. Each cubic foot of water raised above the water level weighs about 62½ lbs. However, these air lift pumps become very inefficient on higher lifts or cannot work at all. A considerable number of inventions have been made to increase the efficiency for higher air lifts but with poor, if any, worthwhile results.

This invention calls for a large head from any desired depth. To accomplish this the air lift pumps herein described do not raise water above the surface level. However, it will be appreciated that the velocity of the entering current can cause a minor rise above the water level. In this lift each cubic foot of water weighs 1 ounce instead of 62½ lbs. This is so efficient that a 10 h.p. compressor can raise 20,000 cu. ft./min. 1,000 h.p. can raise 2,000,000 cu. ft./min; 15,000,000 gals/min; 100 tons/min. Above water this 2,000,000 cu. ft. would weigh 125,000,000 lbs. or 62,500 tons.

The head and volume could be as large as desired. When greater depth is required more power lift units will be attached to the main duct. These air lift units are placed to provide the greatest efficiency for the compressor.

In connection with the dredging capabilities of the present invention, it should be noted that down to depths of approximately 300 feet under water, a 6-inch diameter pipe, supplied with air at 1,000 p.s.i. could be used to gouge out and loosen the bottom for effective suction into the inlet means.

In accordance with the present invention mixed silt, minerals, metals, etc., may be recovered from the floor of substantially any body of water, such as the floor of the ocean, the Continental Shelf, inland seas, rivers or estuaries or materials at any other level, including partially submerged and fully submerged, or floating on such bodies of water, may be recovered or collected and separated by density.

Further, in accordance with the present invention, water either alone or having minerals or other solid or non-miscible materials entrained therein is induced to rise within a conduit and to flow into a recovery vessel or area whereat the flow velocity is progressively decreased so as to release such entrained materials by the specific gravity or density thereof. Hence, as the velocity of the flow of water is decreased, the most dense materials entrained in the flow of water are released from the flow of water first, followed by materials of proportionately lower density.

Where the entrained water and minerals are sucked up from, for example, the ocean floor or Continental Shelf, some of the silt, gravel, and minerals therein will, in accordance with the present invention, be entrained in the flow and sequentially dropped out from the moving flow in the recovery vessel, so that, for example, the gold drops out first, followed by dense rocks, etc., and when the specific density of other valuable materials is reached, such as diamonds, etc., they will similarly drop out from the stream of water. Finally, at the end of the recovery field, the water is returned after all of the wealth entrained or carried thereby has been extracted.

In accordance with the present invention water is induced to upwell through a conduit coming from an intake at the depth from which the materials to be recovered are located. For the collection of mineral laden silt, gravel, etc. the novel inlet structure, in accordance with the present invention is provided extending from the bottom for transmission of the silt and gravel upwardly through the conduit to the recovery field or separation apparatus where the silt, gravel, etc. is not only separated from the entraining stream of water, but where the silt, gravel, etc. is separated into component portions of differing mass or specific density.

Figure 2:
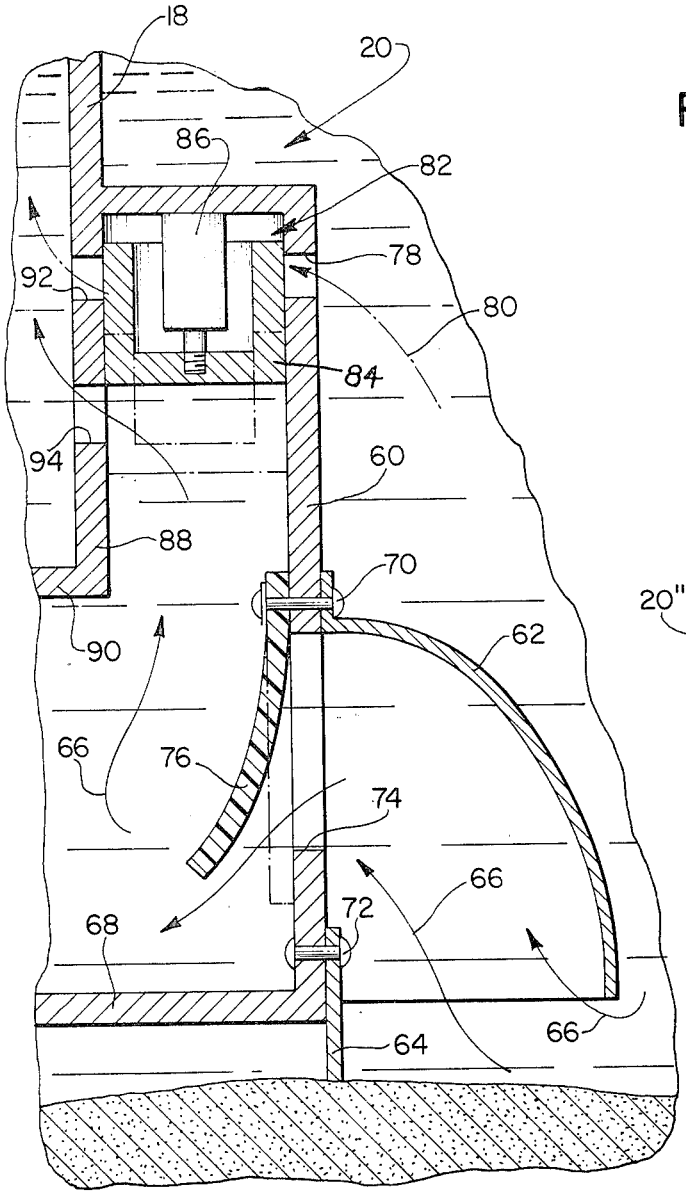
FIG. 2 is a partial cross-sectional illustration of the inlet portion forming a part of the apparatus of FIG. 1.

Hence, in accordance with the present invention, valuable minerals such as gold, diamonds, iron ore, and the like, may be readily, more cheaply and quickly recovered in the gravel and silt on the floor of substantially any body of water.

with reference now to the drawings and particularly to FIGS. 1 and 2 thereof, there is shown and illustrated an apparatus or system constructed in accordance with the principles of the present invention and designated generally by the reference character 12, which comprises a recovery vessel or field designated generally by the reference character 14, comprising the flotation holds 16 and having connected thereto a plurality of conduits 18 which are connected to opposite end portions of the vessel 14 at the upper or outlet end portions thereof, and which, at the lower or inlet end portions thereof are each joined to a novel inlet means 20.

Means, such as air bubblers 22, supplied with compressed air from the vessel 14 through air tubes 24, may be associated with each of the conduits 18 for inducing upwelling therethrough in accordance with my copending earlier application Ser. No. 154,986, filed June 21, 1971, now abandoned. While the present invention is particularly suitable for use with the controlled upwelling induced by air bubbling in accordance with my aforesaid application, it is to be especially pointed out that other pumping means may be used without departing from the scope and spirit of the present invention. The bubbling means 22 will not be further described herein, the description thereof from my said earlier application being expressly incorporated hereat, except to herein state that by the introduction of air or other compressed gas to the bubbling means 22, an upward flow of water through the conduits 18 from the inlet means 20 to the recovery vessel 14 of the apparatus 12 is induced.

If the inlet means 20 is disposed at the bottom of a body of water 26 wherein the vessel 14 is floating or at any other depth therein at which there exists materials or objects which it is desired to recover, then the flow of water through the conduits 18 as the flow enters the inlet means 20 will entrain any such materials, including for example, mineral laden silt and gravels from the bottom of the water depths, other materials floating at any depth therein, and the like. Hence the upwelling or rising water through the conduits 18 creates a suction-like effect at the inlet means 20, causing an inward drawing of not only water but of minerals, sediments, floating bodies, and the like, in the region thereof. For transportation through the conduits 18 to the recovery vessel or field 14 where, in accordance with the present invention, as hereinafter more fully detailed, such entrained materials may be separated from the flow of water and, in addition, separated one from the other, in accordance with their relative specific gravities or densities.

The recovery vessel 12 may, as indicated, be generally symmetric comprising a pair of generally opposed recovery field portions 28 and 30, each of which is generally triangular in configuration extending from a shallow apex region 32 and 34, respectively, to a deeper and wider outlet portion 36 and 38, respectively, with the upper end portions of the conduits 18 being connected with the apex portions 32 and 34, respectively, of the recovery portions 28 and 30. Hence, water flows upward through the conduits 18 and into the recovery portions 28 and 30 through the narrow restricted apeces 32 and 34, respectively thereof and toward the wider outlet portions 36 and 38 respectively. Since the constriction of the flow of water is continually lessened during passage along the recovery portions 28 and 30 toward the respective outlet portions 36 and 38, the velocity of flow therethrough likewise is steadily and proportionately decreased. As the velocity of the flow of water is decreased, its ability to carry or entrain other more dense material likewise proportionately decreases. Thus the heavier matierals entrained in the flow of water upwelling through the conduits 18 are sequentially deposited along the recovery field portions 28 and 30, with the denser materials such as gold, and the like, being deposited first and closer to the respective apeces 32 and 34, with less dense materials, including ores, diamonds and the like, being deposited in striations extending serially along the recovery field of portions 28 and 30. The outlet portions 36 and 38 of the recovery fields 28 and 30 may be provided with outlet control means comprising, for example, outwardly opening gates 40 and 42, respectively, enabling the flow of water, after its velocity has been sufficiently decreased as to cause it to drop or to give up the desired valuable minerals and materials, to return to the sea or body of water 26. As shown, the outlet means 40 and 42 may comprise gates openable outwardly so that, upon the flow of water outwardly herethrough gates 40 and 42 open while, at the same time, when the flow of water therethrough has ceased or cutoff, the gates 40 and 42 close precluding the inrush of sea water therethrough. In this way, the vessel 12 may be designed so that a minimum of freeboard is required and so that the upwelling flow through the conduits 18 need not carry the water upwelled above sea level.

Preferably, however, the vessel 12 is constructed and arranged so as to float at a level so that the lower edge of the gates 40 and 42 are above the surface thereof so that water flowing through the openings and past the gates 40 and 42 will flow therethrough substantially unimpeded. With such construction, the gates 40 and 42 may even be eliminated.

Further, the recovery field portions 28 and 30 are preferably each provided with floor portions 44 and 46 respectively which extend along progressively lower levels from the inlets at the apeces to the outlets at the gates 40 and 42 so that once the water enters the recovery field portions 28 and 30, gravity will induce flow thereof downward along the floor portions 44 and 46, respectively, toward the outlets defined by the gates 40 and 42. The floor portions 44 may, as shown in FIG. 1, comprise steps of progressively lower elevation or may, as will be described in more detail hereinafter, comprise a smooth curve from the inlet to the outlet. Further, a plurality of baffles 48, of progressively lower height, may be extended, respectively, across the recovery field portions 28 and 30 to form, above the floor portions 44 and 46, a plurality of substantially separate compartments into which the materials entrained within the flow of water upwelling through the conduits 18 may be deposited upon separation therefrom. As shown, the baffles 48 may, like the floor portions 44 and 46, be progressively lower as the distance from the apeces 32 and 34 toward the outlet 5 or gates 40 and 42 increases. Hence, as the water flows through the recovery areas or portions 28 and 30, the material entrained therein will be progressively separated therefrom together with the more dense materials falling out of the stream of moving water closer to the apex and with less dense materials being progressively released, separated and collected generally downstream thereof, as the portions 28 and 30 widen and deepen.

The recovery vessel 14, as shown in FIG. 1, may comprise an intermediate wall 50 dividing the vessel generally diagonally so that the recovery field portions 28 and 30 are generally similar although are disposed in opposing directions. Hence, the forces developed in the vessel from the moving water as well as the buildup of cargo due to the materials separated from the moving water will be generally symmetric and in balance without creating any imbalance of forces which might tend to move the vessel 14. When movement of the vessel 14 is desired, however, adjustment of the flow rates between the respective conduits 18 may be utilized to provide for such imbalance of forces and controlled movement of the vessel 14.

Yet, further, the vessel 14 may be provided with one or more engines, wheel, pump or control houses 52 and 54 where the various pumps, engines, living quarters and the like may be located. The engine or pump houses 52 and 54 may, as shown in phantom in FIG. 1, be provided with conduit means 56 and 58 defining the inlet and, in turn, an outlet, respectively, connected with the recovery portion 28 and 30 at the outlet end portions 36 and 38 thereof and the engine or pump houses 52 and 54 being provided with pump means connected between the inlets and outlets 56 and 58 for enabling and controlling the flow of water subsidiary to or in place of the control gates 40 and 42. Further, means (not shown) may be provided for latching the gates 40 and 42 in either the open or closed positions thereof. Yet, further, the vessel 14 may be provided with various subsididary devices for enabling control of the movement thereof, including propulsion means therefor, and the like. In addition, removable pontoons (not shown) may be utilized for support of the vessel 14 and for its transit between the recovery area and port and other subsidiary means may be additionally provided for enabling the loading and unloading of cargo therefrom including hoists, drag buckets, and the like.

Further, in accordance with the present invention, the recovery field portions 28 and 30 may comprise means for recovering and separating objects of substantial size but of similar density, such as, for example, fish, or the like, and for such purpose the baffles 48 may be provided with the suitable perforations or apertures. Still further, the control gates 40 and 42 may be similarly provided with suitable perforations or apertures so as to define screens or filters for collecting fish, and the like recovered through the conduits 18 within the entraining stream of water.

With continued reference to FIG. 1 and, in addition, with more particular reference to FIG. 2, the inlet means 20 connected with the lower end portion of the conduit 18 may, as heretofore pointed out, be particularly constructed and arranged as to be moved or dragged across the bottom of the body of water within which the vessel 14 is floating and, in accordance therewith, may comprise a housing 60 having a scoop or deflector 62 connected with the lower end portion thereof and extending outward therefrom in, for example, a single direction, as shown. Further, a scraper blade 64 may be connected with the housing 60 generally interiorly of the scoop blade 62 and extending downward therefrom as shown in FIG. 2, so that water and any materials entering the inlet means 20 do so by means of a flow having both horizontal and vertical components, as shown by the arrow 66 in FIG. 2. When the water enters the inlet means 20 through the scoop 62, as shown by the solid arrows 66, it is readily apparent that a component of force would be generated in the inlet means 20, tending to move the inlet means 20 in a direction along the floor of the body of water generally opposite to that shown or depicted by the solid arrows 66.

Inlet means 20, therefore, not only is effective for drawing water and gravel, sand, silt and the like, from the floor of the body of water into the conduit 18, but, in addition, as such water and entrained material is drawn into the conduit 18, a component force is generated, tending to drag the inlet means 20 along the floor of the body of water so as to provide movement thereof and a continuous sweeping action therewith. Directional control may be provided by rotating the housing 60 about the lower end portion of the conduit 18 by means of electric or air motors or the like, not shown.

Further, the housing 60 may be provided with a bottom plate 68 completely closing the lower end portion thereof, so that water may only enter the housing 60, except as hereinafter described, through the scoop assembly 62. The scoop 62 may be connected with the housing 60 in any convenient manner as, for example, as by means of a plurality of rivets 70. The scraper blade 64 may be similarly fastened in any convenient manner, for example, as by means of rivets 72. Access to the interior of the housing 60 from the interior of the scoop 62 may be provided by means of an aperture or opening 74. There may be further means provided, such as a rubber or elastomeric flap 76 disposed on the interior of the housing 60, covering the aperture or opening 74 and defining a one way, check, or foot valve to preclude the outward flow of fluid through the aperture 74 and scoop 62. Then, when the bubblers 22 or other pumping means, are shut off, the water and entrained materials within the conduits 18 will be held therein and will not settle back outwardly therefrom enabling the process to be readily and quickly started again without loss.

After the desired quantity of water and entrained material has been upwelled through the conduits 18, and a sufficient quantity of entrained material recovered or separated therefrom in the recovery vessel 12, or when the vessel compartments are full, it will be desirable to be able to stop the flow of water from the scoop 62 so as to stop further movement of the inlet means 20 along the floor of the body of water, until such time as the recovery field portion 28 and 30 can be emptied of their cargo. Such stopping of movement can be easily accomplished by merely terminating the flow of air to the bubblers 22, at which time the foot valve or flap 76 will close the aperture 74 and enable the column of water contained within the conduit 18 to be maintained without disturbance. Since, however, the column of water within the conduit 18 at such time ideally contains a large quantity of entrained material of greater density than that of the water, merely shutting down the bubbler 22 will not provide, at that time, an optimum means of terminating collection operations. More preferably, means may be provided for continuing a flow of relatively clear water upwards through the conduit 18 so as to flush all of the entrained materials upward into the recovery vessel 12.

Such supplemental flow of water preferably is developed in such a way as to provide a balanced force to the inlet means 20 so that further movement thereof along the floor of the body of water will not occur and, traditionally, water should be withdrawn into the inlet means 20 at a level somewhat above the floor of the body of water so as not to cause much additional silt, gravel, or the like, to be drawn into the inlet means 20 and upward through conduit 18. At such time as such flow of water is flushing out the conduit 18, such an additional flow of water to be recovery fields 28 and 30 may also be effective in providing for additional washing and separation of the materials contained therein.

In accordance therewith and with continued reference to FIG. 2, the housing 60 may be provided, generally adjacent to the upper end portion thereof, with a generally symmetric ring of apertures 78 extending thereabout and generally spaced apart from the lower wall 68 thereof to enable a flow of water into the housing 60 at an elevation above the bottom as indicated by the broken arrows 80.

Further, the inlet means 20 may be provided with valve or porting control means 82 comprising, for example, a generally annular spool 84 reciprocal therein as by means of a motor 86 operable by any convenient means such as electrical, pneumatic, hydraulic, or the like, between an upper position as shown in solid lines in FIG. 2 where it precludes a flow of water through apertures 78 while permitting an inflow of water and entrained materials through the aperture 74 and scoop 62 and a lower position shown in phantom lines in FIG. 2 where it blocks the inflow of water and entrained material through the scoop 62 and the scoop aperture 74 while permitting the inflow of water through the ring of apertures 78.

In accordance herewith, the inlet 20 may further comprise a generally central porting sleeve 88, extending generally concentrically of the housing 60 and closed at the lower end by means of a closure plate 90.

The porting sleeve 88 may be provided with an upper set of ports 92 adapted to be covered by the spool 84 when in the upper position therefor and a lower set of ports 94 adapted to be opened or exposed simultaneously therewith.

Hence, when the spool 84 is in the upper position, fluid, water and entrained materials are free to flow, as shown by the solid arrows 66 inward of the scoop 62 through the aperture 74 and past the valve or porting control member 84 into the conduit 18 through the ports 94, while at the same time, the ports 94 and the apertures 78 are closed or blocked thereby. When the valve or porting control member 84 is moved to the lower position thereof, then the ports 94 are closed thereby precluding the flow of water and entrained materials inwardly through the scoop aperture 74 and the lower ports 94, while permitting the flow of water from above the floor of the body of water inward through the ring of apertures 78 and through the upper port 92 into the conduit 18 for the flushing of conduit 18 thereby. Since the apertures 78 are extended generally symmetrically about the nozzle assembly 20, the forces applied to the nozzle assembly 20 are generally in balance and no tendency toward movement occurs.

Figure 3:
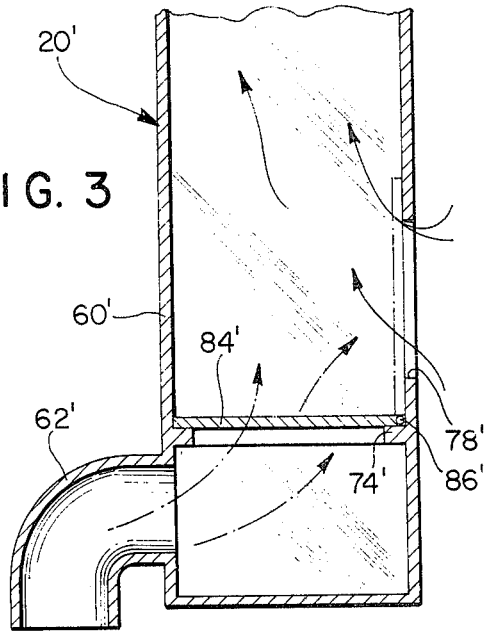
FIG. 3 is a diagrammatic cross-sectional illustration similar to FIG. 2, of another inlet portion which may be used with the present invention.

With reference now to FIG. 3, there is shown and illustrated a similar inlet means designated generally by the reference character 20', suitable for use with the present invention. The inlet means 20' is in many respects similar to the inlet means 20 and consequently similar reference characters will be utilized, except that the reference characters which apply to FIG. 3 and the inlet means 20' illustrated therein are primed. The inlet means 20' is of substantially simpler construction and comprises a housing 60' of generally rectangular configuration, at least beneath the scoop member 62' which extends generally outwardly from one side thereof. The valve member 84' may then comprise a simple porting plate 84' hingedly mounted, as by means of a hinge means 86', for pivotal movement between a generally vertical upper position shown in phantom lines blocking an inlet port 78' and a generally horizontal lower position blocking an inlet port 74' communicating with a scoop 62', so as to provide for a selective flow of water and any entrained materials generally inwardly through either of the ports 74' or 78'.

As heretofore pointed out, where the inlet is imbalanced, as is the case in the inlet means 20 of FIG. 2, when flow is through the aperture 74 and within the scoop 62, and as is also the case in either position of the porting plate 84' of the inlet means 20' of FIG. 3, the inlet means tends to move in the direction of the water inlet, while, when the flow therein is balanced as occurs when flow is through the ring of apertures 78 in FIG. 2, the nozzle tends to remain generally stationary.

In addition to the imbalanced flow and the forces resulting therefrom which tend to move the inlet means of the present invention, the inlet means of the present invention may, where desired, be provided with motors, draglines, tractor means, or the like to enable more positive control of the movement thereof, to assist the movement thereof through the imbalanced forces or even to oppose the imbalanced forces. Furthermore, inlet means may be constructed in accordance with the present invention wherein the fluid intake is balanced at all times and movement is provided solely by means of motors, draglines, tractor means or the like.

Figure 4:
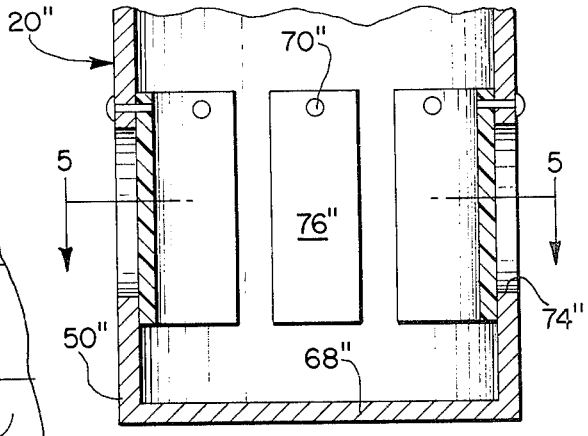
FIG. 4 is a partial diagrammatic cross-sectional illustration of an another nozzle similar to that of FIGS. 2 and 3.
Figure 5:
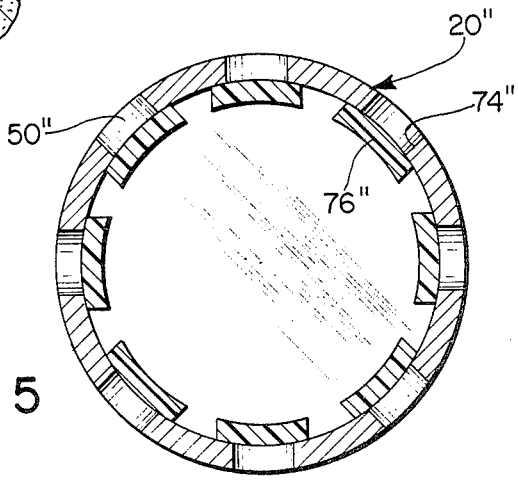
FIG. 5 is a cross-sectional illustration taken along line 5—5 of FIG. 4.

With reference now to FIGS. 4 and 5, there is shown and illustrated another inlet means constructed in accordance with the present invention which provides for a substantially complete balance of forces to preclude any tendency toward movement generated by the fluid forces.

Such inlet means is designated generally by the reference character 20''. As with the already described inlet means 20', similar reference characters will be used as were used with the inlet means 20 with the exception that the reference characters in connection with FIGS. 4 and 5 are double-primed. In accordance with FIGS. 4 and 5, inlet means 20'' comprises a general cylindrical housing or casing 60'', provided with a ring of apertures 74'' generally symmetrically arranged thereabout to provide a balanced influx of water and entrained materials that therefore provide a balance of forces acting on the casing 60''. Further, the intake casing 60'' may comprise a bottom closure plate 68''.

In order to provide for a footvalve or one-way check action so as to maintain at all times a column of fluid within the conduit 18, the nozzle assembly 20'' may further be provided with a plurality of rubber or elastomeric flexible closure members or flaps 76'', one closure member or flap 76'' being associated with each of the apertures or ports 74'' generally internally thereof and hingedly connected to the housing or casing 60'' as by means of a plurality of rivets 70''.

Figure 6:
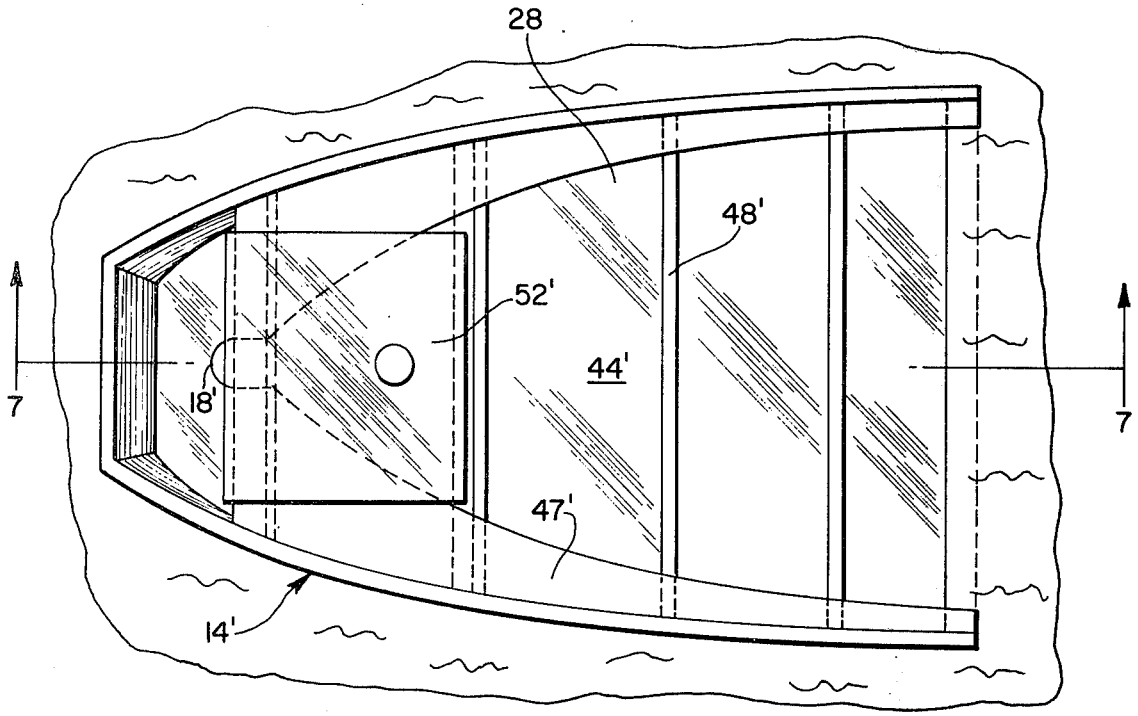
FIG. 6 is a diagrammatic illustration of another vessel similar to that of FIG. 1, suitable for use in practicing the present invention.

As heretofore pointed out, the recovery vessel 14 shown and illustrated in FIG. 1 is generally symmetrical so as to provide a substantial balance of the forces from the flow of water therethrough. The said balanced configuration has the advantage of providing for a balanced force application to the vessel 14. However, a vessel such as that depicted in FIG. 1, has a number of disadvantages which, under certain circumstances, may prove to be more disadvantagous than the advantages deriving from the balanced force configurations. For example, a vessel such as that shown and illustrated in FIG. 1, is not particularly streamlined and is not particularly welldesigned for open water operation, nor is it an efficient design for long distance travel. Additionally, such design requires that the vessel be specially designed and built and may not be economically constructed by conversion from a conventional ship. Hence, and with reference now to FIGS. 6 and 7, there is shown and illustrated a vessel 14' which is not symmetrical, but, rather, which is designed along the general lines of a more conventional ship, and which may be constructed economically by conversion from a conventional vessel while yet being suitable for use with the present invention, and constructed and arranged to enable sequential separation of materials of greater and lesser density entrained within a flow of water induced to upwell through the conduit 18', extending into depths of a body of water within which the recovery vessel 14' is disposed by means of a bubbler arrangement or apparatus 22'.

Figure 7:
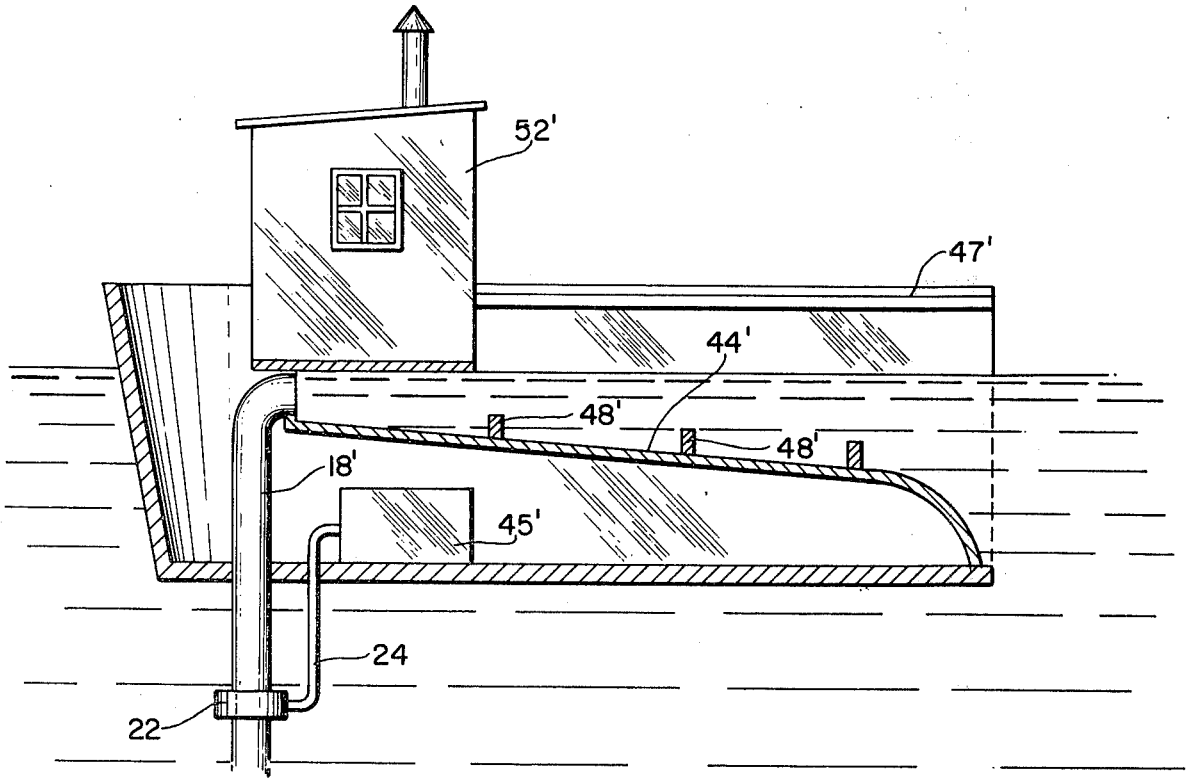
FIG. 7 is a cross-sectional elevational view taken along line 11—11 of FIG. 10.

The conduit 18' may extend upward into the vessel 14' at the bow of the vessel and at the apex of a generally curved triangular recovery field portion 28' disposed within and following the lines of the hull thereof, the floor 44' of which extends from an apex adjacent the bow of the vessel 14', rearwardly therefrom, diverging to a generally open and unobstructed weir extending through the transom. Yet further, while the recovery field 28' diverges generally horizontally towards the transom of the vessel 14', simultaneously therewith, it is preferable that the floor 44′ thereof also diverge, downward towards the stern. As heretofore pointed out and as shown and illustrated in FIG. 1, the bottom walls 44′ of the recovery field portions 28 and 30 may be stepped, or such bottom walls or floors may be of general uniformly linear or curvilinear configuration, from the apex or inlet to the wide outlet, as shown in FIG. 7.

Hence, there is defined a continually widening recovery field portion 28′ within the vessel 14′ within which the flow of water and entrained material upwelling through the conduit 18′ may expand and wherein the velocity thereof is sequentially and substantially reduced. As the velocity of the water with entrained materials flowing through the recovery field portion 28′ is reduced, materials of greater density drop foremost, with materials of lessening density dropping across the stern of the vessel, until very light materials, such as silt and the like, are carried by the stream of flowing water generally outwardly and rearwardly to the transom of the vessel 14′.

If it is desired to maintain the dredgings, then suitable filter means may be provided extending across the transom of the vessel 14′.

Further, the floor 44′ of the vessel 14′, in accordance with the present invention, may be provided with a plurality of baffle strips 48′ so as to form particular and specific compartments the moving stream of water. In addition, the vessel 14′ may comprise a pump 45′ for pumping air to the air bubbler 22, as well as a drive comprising an engine, propeller shaft and screw, etc., not shown, as well as a deck 47′ and wheel house 52′.

Hence, there have been described and disclosed novel and improved methods and apparatus for enabling the recovery of minerals, from the floors of bodies of water. In addition, recovery fields have been described for not only recovering such minerals but, in addition, for simultaneously separating such minerals or other materials by density or specific gravity so that more dense materials or minerals are automatically and continuously separated from less dense materials and minerals, enabling increased production of valuable minerals, such as gold, diamonds, metallic ores, and the like, from silts, gravels and the like, dredged up from the floors of bodies of water in accordance with the present invention.

When it becomes necessary to separate lighter material with a more even density, such as precious or semi-precious stones, from sand and gravel, a trap door arrangement can be used to drop the undesired denser material into the ocean.

The materials similar in density to the desired minerals can be further sorted by use of appropriate screens and the desired materials obtained.

Further, by positioning to the inlet means, at depths intermediate the depth of the body of water within which the recovery vessel floats, other materials such as fish and the like, may be recovered.

While the invention has been described, disclosed, illustrated and shown in certain terms or certain embodiments or modifications which it has assumed in practice, the scope of the invention should not be deemed to be limited by the precise embodiments or modifications herein described, disclosed, illustrated or shown, such other embodiments modifications as may be suggested as those having the benefit of the teachings herein, being particularly reserved especially as they fall within the scope and breadth of the claims here appended.

What is claimed is:

1. Apparatus for recovering and separating materials from a body of water comprising, in combination:

conduit means having an inlet means and an outlet means;

said inlet means disposed below the surface of the body of water at a depth lower than said outlet means at a depth where materials to be recovered and separated are located;

means operatively associated with said conduit means for inducing upwelling of water and any such entrained material as may be drawn into said inlet means generally upwardly through said conduit means to and through said outlet means;

a vessel including a deck which extends above the surface of the body of water and generally divergent material recovery field having an apex inboard of said vessel operatively connected to said outlet means and a wider outlet portion for discharge from said vessel of the remaining upwelled water and entrained material to the body of water;

said recovery field including a plurality of floor portions lower than the level of said deck and extending along progressively lower levels from said apex to said outlet portions, and baffles separating each of floor portions, each baffle having an upper edge higher than either of its associated floor portions, the upper edges of said baffles being progressively lower as the distance from said apex toward said outlet portion increases.

2. Apparatus for recovering and separating materials from a body of water comprising, in combination:

conduit means having an inlet means and an outlet means;

said inlet means disposed below the surface of the body of water at a lower depth than said outlet means at a depth where materials to be recovered and separated are located;

means operatively associated with said conduit means for inducing upwelling of water and any such entrained materials drawn into said inlet means to induce an upward flow of water and entrained materials from said lower depth to said outlet means;

a vessel having at least two generally divergent material recovery fields having an apex operatively connected to said outlet means and a wider outlet portion for discharge from said vessel of the remaining upwelled water and entrained material to the body of water, said material recovery fields being generally opposed to one another and providing a substantial balance of forces generated in said vessel by the flow of upwelled water.

3. Apparatus as defined in claim 2 wherein each of said material recovery fields includes a plurality of floor portions extending along progressively lower levels from said apex to said outlet portions, and baffles separating each of said floor portions, each baffle having an upper edge higher than either of its asociated floor portions, the upper edges of said baffles being progressively lower as one advances from said apex toward said outlet portion.

4. Apparatus as defined in claim 3 wherein each of said material recovery fields further includes a movable gate selectively operable between opened and closed positions to control the flow of the upwelled water out of said recovery field and to preclude the inrush of water surrounding said vessel.

5. Apparatus for recovering and separating materials from a body of water comprising, in combination:

conduit means having an inlet means and an outlet means, said inlet means disposed below the surface of said body of water at a lower depth than said outlet means at a depth where said materials to be recovered and separated are located;

material recovery means associated with said outlet means of said conduit;

means operatively associated with said conduit means for inducing upwelling of water and any such entrained materials drawn into said inlet means to induce an upward flow of water and entrained materials from said lower depth to said outlet means;

means associated with said material recovery means for inducing a flow velocity loss to the upwelled water and entrained materials flowing from said outlet means to induce separation of materials from said upwelled water;

said inlet means including an enclosed housing having an aperture on one side only and adjacent to the bottom thereof permitting flow of surrounding water into said conduit and a scoop mounted on said housing and extending generally outwardly and downwardly with its concave surface facing said aperture, so as to sweep silt, sand, gravel, minerals and the like into said inlet means from the bottom of the body of water and such that simultaneously the flow of water into said inlet means creates imbalanced forces, tending to move said inlet means within the body of water in a direction toward said aperture.

6. Apparatus defined in claim 5 comprising check valve means mounted on said housing adjacent said aperture operable to permit the inward flow of water to said conduit and to prevent the outward flow of water from said conduit.

7. Apparatus as defined in claim 5 further comprising a scraper blade mounted to said housing and extending downwardly therefrom adjacent said scoop for agitating the bottom of the body of water and dislodging embedded materials.

8. Apparatus as defined in claim 5 wherein said housing has a plurality of ports located symmetrically thereabout and spaced a substantial distance above said aperture, and comprising valve means selectively operable between one position whereat it precludes a flow of water through said ports while permitting a flow of water through said aperture, and another position whereat it permits a flow of water through said ports while precluding a flow of water through said aperture, thereby in the latter instance, enabling the upwelling of relatively clean water without entraining silt, sand, gravel and the like from the bottom of the body of water.

9. Apparatus for recovering and separating materials from a body of water comprising, in combination:

conduit means having an inlet means and an outlet means, said inlet means diposed below the surface of said body of water at a lower depth than said outlet means at a depth where said materials to be recovered and separated are located;

material recovery means associated with said outlet means of said conduit;

means operatively associated with said conduit means for inducing upwelling of water and any such entrained materials drawn into said inlet means to induce an upward flow of water and entrained materials from said lower depth to said outlet means;

means associated with said material recovery means for inducing a flow velocity loss to the upwelled water and entrained materials flowing from said outlet means to induce separation of materials from said upwelled water;

said inlet means including a generally cylindrical enclosed housing having a plurality of apertures generally symmetrically arranged thereabout adjacent the bottom thereof and foot valve means associated with each of said apertures and operable to permit the inward flow of water to said conduit and to prevent the outward flow of water from said conduit.

10. A method of recovering materials from a body of water comprising at least the steps of:

inducing upwelling of water from a depth below the surface of the body of water through a conduit having inlet means disposed at a depth below the surface of the water where materials to be recovered are located;

entraining the materials to be recovered within the water upwelled through the conduit;

discharging said upwelled water into a materials recovery means from an outlet means of the conduit positioned slightly below the surface of the body of water; and inducing a controlled flow velocity loss in the upwelled water to induce selective separation of material entrained in the upwelled water.

11. A method as defined in claim 10 comprising the steps of:

providing the inlet means with an imbalance of forces during the step of upwelling to cause movement thereof through the body of water.

12. A method of recovering materials from a body of water comprising, at least the steps of:

inducing upwelling of water from a depth below the surface of the body of water through a conduit having inlet means disposed at a depth below the surface of the water where materials to be recovered are located;

entraining the materials to be recovered within the water upwelled through the conduit;

providing a vessel;

discharging said upwelled water into a pair of generally divergent material recovery means within the vessel each from an outlet means of the conduit positioned slightly below the surface of the body of water and in opposite directions to provide a substantial balance of forces generated within the vessel; and inducing a controlled flow velocity loss in the upwelled water to induce selective separation of materials entrained in the upwelled water.

* * * * *